US005669075A

United States Patent [19]

Weeks

[11] Patent Number: 5,669,075

[45] Date of Patent: Sep. 23, 1997

[54] HAT PROVIDING ULTRA VIOLET RADIATION PROTECTION

[76] Inventor: David J. Weeks, 121 Rosedale Avenue, Halifax, Nova Scotia, Canada, B3N 2J6

[21] Appl. No.: 602,196

[22] Filed: Feb. 16, 1996

[30] Foreign Application Priority Data

Jan. 19, 1996 [CA] Canada ..... 2167619

[51] Int. Cl.[6] ..... A42B 1/06

[52] U.S. Cl. ..... 2/172; 2/7; 2/195.1; 2/195.6; 2/200; 2/1; 2/209.13

[58] Field of Search ..... 2/7, 171, 172, 2/175.1, 175.3, 175.5, 181, 181.4, 195.1, 195.6, 200.1, 209.13, 410

[56] References Cited

U.S. PATENT DOCUMENTS

| | | | |
|---|---|---|---|
| 350,398 | 10/1886 | Shunk | 2/209.13 |
| 2,449,633 | 9/1948 | Albert et al. | 2/172 |
| 2,462,258 | 2/1949 | Dannenberg | 2/172 |
| 2,663,024 | 12/1953 | Cantor | 2/177 |
| 2,686,917 | 8/1954 | Auerbach | 2/172 |
| 2,743,454 | 5/1956 | Woodbury | 2/172 |
| 2,897,510 | 8/1959 | Forbes-Robinson | 2/172 |
| 4,782,103 | 11/1988 | Ogoe | 524/83 |
| 4,810,490 | 3/1989 | Dixon et al. | 424/59 |
| 4,859,184 | 8/1989 | Hazard | 433/136 |
| 4,904,508 | 2/1990 | Madonia | 428/31 |
| 4,951,319 | 8/1990 | Phillips, Jr. et al. | 2/171 |
| 4,982,449 | 1/1991 | Finkelstein | 2/195.6 |
| 5,026,540 | 6/1991 | Dixon et al. | 424/60 |
| 5,081,717 | 1/1992 | Shedd et al. | 2/181.4 |

FOREIGN PATENT DOCUMENTS 168063 3/1916 Canada .

OTHER PUBLICATIONS

Pharmasave Healthnotes—Practical Information From Your Neighbourhood Pharmacist—Premiere Issue Jul. 1995.

Protection of Humans from Ultraviolet Radiation Through the Use of Textiles: A Review, by Linda Capjack et al. published Dec. 1994, pp. 198 to 218, in the Family and Consumer Sciences Research Journal.

*Primary Examiner*—Diana Biefeld
*Attorney, Agent, or Firm*—Barrigar & Moss; Peter R. Hammond

[57] ABSTRACT

A ligtweight cloth hat for warm weather use and for protection from the sun's ultraviolet rays including a main section capable of covering the top of a user's head and having a top with a side wall extending down from the top to a peripheral edge. A Visor section is connected to this edge at the front side. A flap section is connected to the peripheral edge at a rear side of the main section. During use of the hat, this flap section extends downwardly from the main section a substantial distance which is sufficient to protect the wearer's neck and ears. At least the main section and the flap section comprise first and second outer layers of tightly woven, thin flexible cloth material and at least one thin inner layer of flexible cloth material. The inner layer is preferably made of a dense interfacing material that is at least 50 percent polyester. The layers are secured together by stitching. Both the visor section and the three layers of material in combination are sufficiently dense and opaque to prevent all ultraviolet sun rays from passing through the visor section and the layers to the wearer's head, neck and ears. Preferably the main section and the flap section have two thin, inner layers of interfacing material.

18 Claims, 3 Drawing Sheets

HAT PROVIDING ULTRA VIOLET RADIATION PROTECTION

BACKGROUND OF THE INVENTION

The present invention relates to cloth hats suitable for warm weather use and, in particular, to such hats capable of providing sun protection.

A variety of hat types are known and have been used in the past. Some of these hats are designed for cold weather and have the objective of keeping the user's head and possibly his neck region as well warm. Other hats have been designed for rainy weather and these hats seek to keep the user's head dry. Other hats are intended for use in warm weather. These includes the well known sports caps which have an elongated peak or visor provided to keep the sun's rays off of the user's face and, in particular, away from the user's eyes. The latter hats are sometimes made with a plastic mesh material that is capable of providing ventilation but which provides little protection from the ultraviolet rays of the sun. Some summer caps are made with a cloth material but often this cloth material is excessively warm, particularly in hot weather and, generally speaking, these hats provide little or no protection for the lower part of the user's head or for the neck region.

Broad brimmed hats Such as sombreros and some military or western style hats can provide some protection from the sun for both the user's head and neck regions. However, often these hats are quite heavy and can be uncomfortable to wear for many users. In addition, many persons who should be wearing hats in sunny weather may not like this style of hat with its broad brim. In addition, such hats may be felt to be inappropriate for wear in some areas or locations where hats are required, for example in ballparks that have no protective roof and on beaches.

U.S. Pat. No. 2,449,633 issued Sep. 21, 1948 to N. Albert et al. describes a hat or cap suitable for inclement weather. The cap has a crown with a front visor. A band of cloth material extends around the sides and back of the crown and an edge of this band is attached to the bottom edge of the crown by stitches. The band includes a depending outer layer 17 which is superimposed on an inner layer 15. The band is capable of covering the wearer's ears and the back of his head.

U.S. Pat. No. 2,743,454 issued May 1, 1956 to R. L. Woodbury describes a winter cap having a flap which extends over the ears of the wearer and protects them from cold. The downwardly extending flap is attached to the bottom edge of the side wall of the hat by stitches. At the front of the flap on both sides of the hat are integral extensions that form chin straps that can be detachably connected under the chin of the wearer. Both the hat and the flap are made from a suitable wind resistant and water repellent woven fabric such as woven cotton twill. The inner face of the flap and the chin straps as well as the hat itself are lined with pile fabric lining. This hat would be unsuitable for summer use as it would be far too warm and uncomfortable.

U.S. Pat. No. 2,897,510 issued Aug. 4, 1959 to C. E. Forbes-Robinson describes both a sports hat and a shield designed especially to protect the hair and neck of a female user from the wind. In the shield version, there is an upper section designed to fit over a lady's sports cap. Attached to this upper section is a hood comprising a rectangular sheet of flexible material. The hood can be sufficiently long to hang down to the shoulders and thus fully cover a lady's hair. Fastening devices can be provided at the front bottom corners of the hood so that these corners can be secured together. This shield is preferably fabricated from a cloth such as silk or cotton and it said to be sheer or thin. Because only a single thin layer of cloth material is used for the hood, this known hood would not provide adequate protection from the sun's ultraviolet rays when the wearer is exposed to the sun for a substantial length of time.

It is an object of the present invention to provide a cloth hat suitable for warm weather use which will provide generally complete protection from the sun's ultraviolet rays even if the user is exposed to such rays for a long period of time. This protection extends not only to the head of the user but also to the neck region which is often exposed when other types of hats are used.

It is a further object of the invention to provide a good warm weather hat that includes a visor section and a flap section that extends downwardly to cover the user's neck, which hat is inexpensive to make and is capable of providing excellent protection from the ultraviolet rays of the sun.

SUMMARY OF THE INVENTION

According to one aspect of the invention, a cloth hat for warm weather use comprises a main section capable of covering the top of a user's head and having a top with a sidewall extending down from the top to a peripheral edge. A visor section is connected to the peripheral edge at a front side of the main section. This visor section during use of the hat extends generally forwardly from the main section and has a width approximating the width of the hat. A flap section is connected to the peripheral edge at a rear side of the main section. This flap section during use of the hat extends generally downwardly from the sidewall of the main section a substantial distance which is sufficient to protect the wearer's neck from sun rays. At least the main section and the flap section comprise first and second outer layers of tightly woven, thin, flexible cloth material and two thin inner layer of flexible cloth material sandwiched between the outer layers. These layers are secured together by stitching. Both the visor section and the three layers of material in combination are sufficiently dense and opaque to prevent all ultraviolet sun rays from passing through the visor section and the layers to the wearer's head or neck.

In a preferred embodiment, the first and second outer layers are both made of woven cotton and polyester.

According to another aspect of the invention, a cloth hat for warm weather use includes a main section capable of covering the top of a user's head and having a top with a sidewall extending down from the top to a peripheral edge and a visor section connected to the peripheral edge at a front side of the main section. The visor section during use of the hat extends generally forwardly from the main section and has a width approximately the width of the hat. A flap section is connected to the peripheral edge at a rear side of the main section. The flap section during use of the hat extends generally downwardly from the sidewall of the main section a substantial distance which is sufficient to protect a user's neck from sun rays. At least the main section and the flap section comprise first and second layers of tightly woven, thin, flexible cloth material and at least one inner layer of flexible cloth material sandwiched between the outer layers. The layers are secured together by stitching. Both the visor section and the three layers of material in combination are sufficiently dense and opaque to prevent all ultraviolet sunrays from passing through the visor section and the layers to a user's head or neck. The one or more inner layers comprise chopped strand mat made of polyester.

In a particularly preferred embodiment the first and second outer layers each comprise 50% cotton and 50% polyester fibres.

Further features and advantages will become apparent from the following detailed description taken in conjunction with the drawings.

DETAILED DESCRIPTION OF PREFERRED EMBODIMENTS

Figure 1:
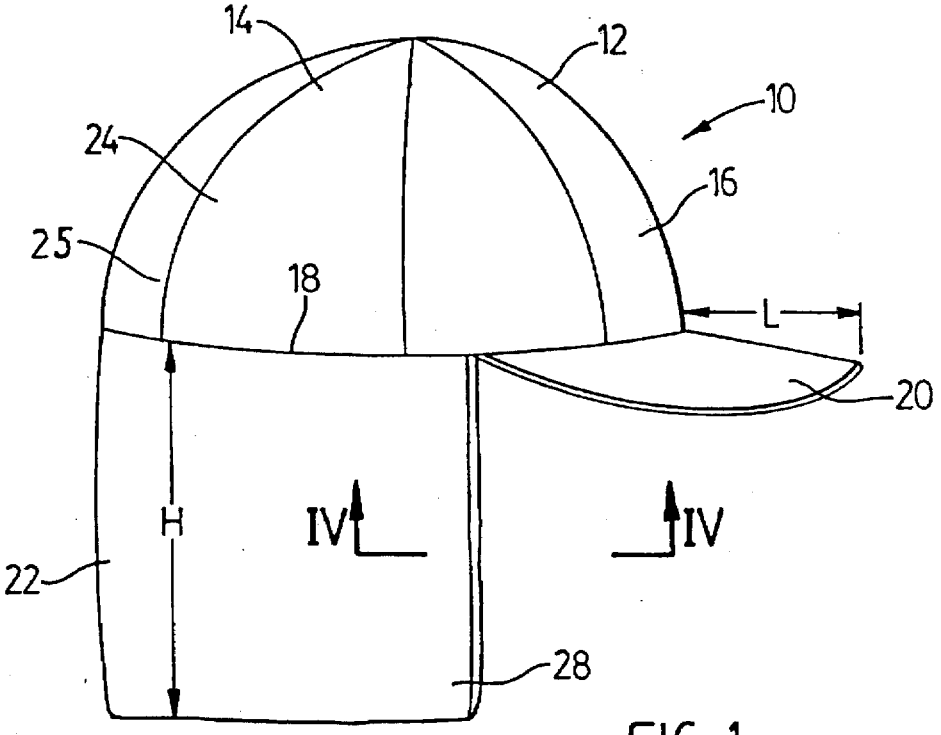
FIG. 1 is a side view of a cloth hat constructed in accordance with the invention.
Figure 2:
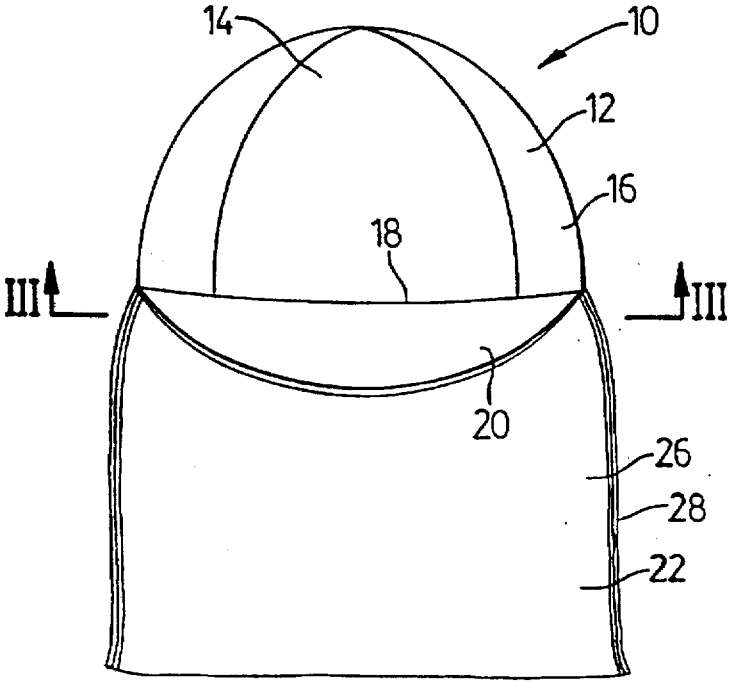
FIG. 2 is a front view of the cloth hat of FIG. 1.
Figure 3:
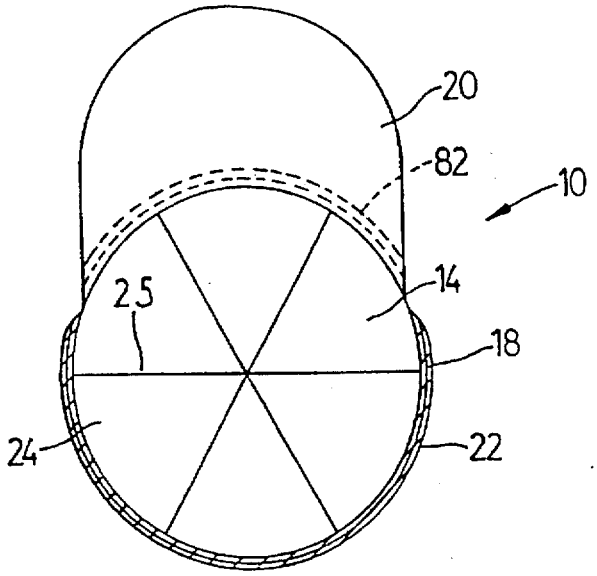
FIG. 3 is a bottom view taken in cross-section along the line III—III of FIG. 2.

A cloth hat 10 suitable for warm weather use is shown in FIGS. 1 to 3. The hat 10 has a main section or crown section 12 which in this embodiment has a generally hemispherical shape and which is capable of covering the top of a user's head. This main section has a top 14 with a sidewall 16 that extends down from the top to a peripheral edge located at 18. A visor or peak section 20 is connected to the peripheral edge 18 at a front side of the main section. The visor section during use of the hat extends generally forwardly from the main section and preferably has a width approximating the width of the hat as indicated in FIG. 2. The visor section may also extend slightly downwardly from the horizontal plane when worn and it may be somewhat curved from the left side to the right side of the hat in a manner which is well known for caps of this general type. It is preferred that the visor section have a substantial horizontal length (indicated by dimension L in FIG. 1) in order to provide good protection from the sun's harmful rays for the face of the user.

The hat 10 also preferably includes a relatively large flap section 22 which, in the embodiment of FIGS. 1 to 3, is permanently attached to the peripheral edge 18 at a rear side and also at the right and left sides of the main section 12. The flap section as shown extends generally downwardly from the side wall 16 of the main section a substantial distance which is sufficient to protect the wearer's neck from sun rays. This distance indicated by the dimension H in FIG. 1 will vary depending upon the size of the hat but preferably is about 6 inches or more and is at least 5 inches in order to provide adequate neck coverage. The preferred flap section is generally rectangular in shape with its height H being the shorter dimension.

The illustrated hat 10 has a main section 12 comprising six sectors 24 that meet at the top of the hat as clearly shown in FIG. 3. These sectors are stitched together at their adjacent straight edges 25. The arcuate edge of each sector when combined with the other sectors forms the peripheral edge 18.

Figure 4:
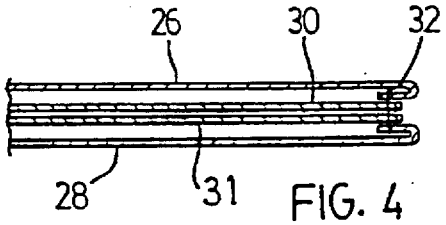
FIG. 4 is a cross-sectional detail taken along the line IV—IV of FIG. 1, which detail shows the layers of cloth used in making the hat.

At least the main section 12 of the hat 10 and the flap section 22 are made of lightweight cloth material suitable for summertime use and yet these sections are made in such a manner that they provide complete blockage from the sun's ultraviolet rays which can be damaging to a person's skin, particularly after periods of prolonged exposure. The manner of constructing the main section 12 and the flap section 22 is detailed in FIG. 4 which shows the use of first and second outer layers 26 and 28 of tightly woven, thin flexible cloth material together with two thin inner layers 30, 31 of flexible cloth material sandwiched between the outer layers. These layers are secured together by means of the usual stitching 32 which can be done in such a manner that it is hidden from view. The four layers 26, 28, 30 and 31 in combination are sufficiently dense and opaque to prevent all ultraviolet sun rays from passing through the layers to the wearer's head or neck. The visor section can also be made of the same four layers of material either alone or in combination with one or more other layers resulting in the visor section also being sufficiently dense and opaque to prevent all ultraviolet sun rays from passing through it. It is also possible to make the main section 12 and the flap section 22 with a single inner layer and obtain substantial protection from the sun's ultraviolet rays.

In one preferred embodiment the first and second outer layers 26 and 28 are both made of woven cotton and polyester. One particularly preferred combination of fibres for the first and second outer layers comprises 50% cotton and 50% polyester fibres. The preferred cloth for the inner layer or layers 30, 31 is a lightweight interfacing fabric which per se is of known construction and available at most fabric supply outlets. In one preferred embodiment of the hat, the interfacing is woven and has a mesh like appearance. This type of interfacing can be 50% rayon and 50% polyester, has a thread designation of 138/in$^2$, a gauge of 0.0079 inch, a porosity of 25% and a weight of 0.0581 gm/in$^2$. When combined with other layers of materials, it provides added strength and has a straightening effect on the fabric. Air is able to pass both through this material and the thin cotton and polyester layers so that the multiple layer combination that forms the main section of the hat and the flap will permit some air to pass through, which is important in warm weather conditions, while still preventing damaging ultraviolet rays from passing through.

Other suitable fibre combinations for the outer layers 26 and 28 are 65% polyester and 35% rayon or thin layers of 100% woven cotton. Although denim, corduroy and khaki cloth could also be used for one or both outer layers, such cloths are generally less desirable for warm weather conditions as they tend to be too hot.

Another preferred form of interfacing fabric for the inner layer or layers is made of 100% polyester in a chopped strand mat. This material has a gauge of 0.0006 inch and a weight of 0.0547 gm/in$^2$.

Figure 5:
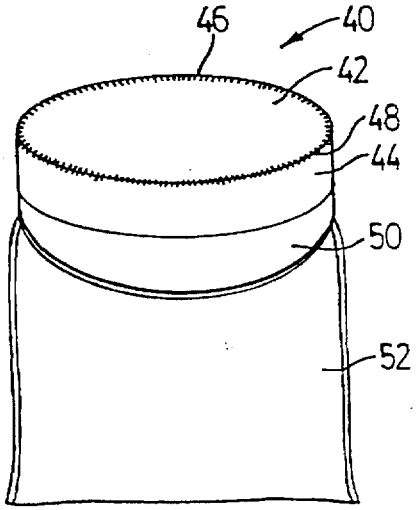
FIG. 5 is a perspective view of another embodiment of a hat constructed in accordance with the invention, this view being taken from the front.
Figure 6:
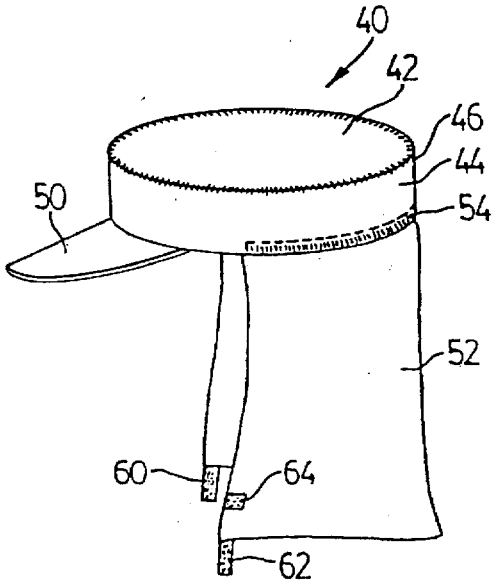
FIG. 6 is another perspective view of the hat of FIG. 5, this view being taken from the right side.

FIGS. 5 and 6 illustrate another form of hat or cap 40 constructed in accordance with the invention. This hat has a top or crown 42 that is round or oval-shaped and the sidewall of this hat comprises a continuous band 44 stitched to a peripheral edge of the crown 42. The ends of the band 44 can be stitched together at the rear of the hat indicated at 46. The stitching 48 around the periphery of the crown 42 can be exposed as shown in the drawings or it can be done in a manner whereby it is hidden from external view. As in the first embodiment of FIGS. 1 to 3, this hat 40 is also equipped with a peak or visor indicated at 50 and a neck protecting flap 52 which is permanently stitched to the bottom edge of the band 44. The stitching 54 that connects the flap at the top edge again can be carried out so that it is hidden from external view in a manner known per se, resulting in the hat having a pleasing appearance.

An optional feature of the hat 40 is the provision of flap connecting device indicated at 60 and 62 arranged on bottom corner sections located at opposite ends of the flap. These connecting devices are for the purpose of joining the opposite ends of the flap together during use of the hat. This can provide additional protection from the rays of the sun, particularly in windy conditions and these devices can also be helpful in holding the hat on the user's head. One preferred form of connecting device comprises multiple hook and loop fastening tapes commonly sold under the trade-mark VELCRO. For example, the connecting device 60 can comprise a cloth strip having multiple loops covering one surface while the connecting device 62 comprises a cloth strip having multiple hooks on one surface. If desired, a small patch of multiple loops 64 can be provided near the strip 62 having multiple hooks thereon so that the strip 62 can be secured against the side of the flap 52 when not in use. It will be understood that due to the height of the flap 52 and the fact that it extends around the side of the user's head, the connecting devices 60 and 62 can generally be attached under the chin of the user. These connecting devices can also be usefully employed when the wearer is running or playing an active sport requiring considerable movement. It will be appreciate that other forms of connecting devices can also be used to attach the bottom corners of the flap together. For example, one could use one or two buttons together with button holes. It would also be possible to use snap fasteners or a metal hook and cooperating slot or loop type fasteners.

Figure 7:
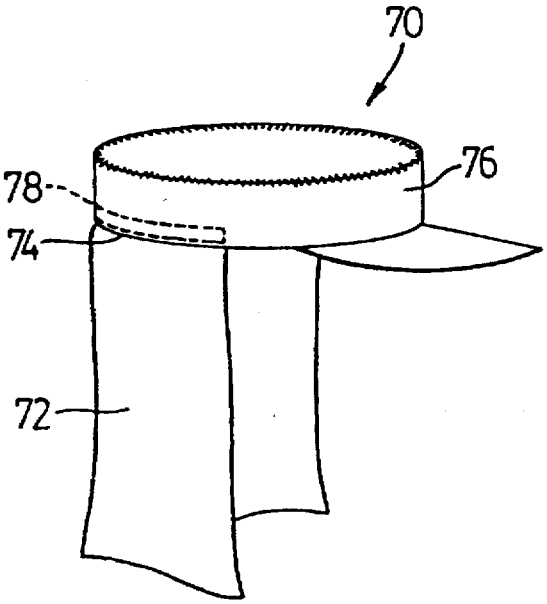
FIG. 7 is a perspective view of a further embodiment of the invention wherein the flap is detachable from the hat, this view being taken from the front and left side of the hat.

FIG. 7 illustrates a hat 70 similar to that shown in FIGS. 5 and 6 but which has a detachable flap 72. Again, the flap section is generally rectangular and is connected to the peripheral edge 74 of the rear and left and right sides of the main section 76 of the hat. In the illustrated preferred embodiment, the flap 72 is detachably connected by means of multiple hook and loop type connecting tape sections indicated in dashed lines at 78. Of the two tape sections, one section is of course secured to a top edge of the flap section 72 while the other tape section is secured to the main section 76 of the hat. In order that the hat will be comfortable to wear when the flap is not in use, it is preferred that the tape section attached to the main section be one having multiple loops thereon. It is, of course, possible for these tape sections to be either located on the inside or the outside of the sidewall of the hat. The multiple loop tape section can be secured to the sidewall of the hat by sewing and the other tape section can be secured to the top edge of the flap in a similar manner. Of course, other types of connectors can also be used to detachably connect the flap 72 to the hat. For example, a series of buttons could be provided along the top edge of the flap, which buttons would be inserted through button holes formed in the side wall of the hat. Metal hooks and loops could also be used.

Figure 8:
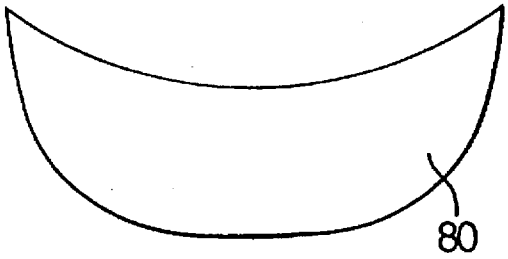
FIG. 8 is a top view of a plastic insert for a peak or visor of a hat.

FIG. 8 illustrates an optional relatively stiff, plastic or cardboard insert that can be used in the visor or peak of the hat. This insert 80 can have the general overall shape of the peak or visor and can extend substantially the width of the visor. If desired, it can have a slight downwardly facing concave curve in order to impart a similar curvature or shape to the visor section. The insert can be permanently sewed into the visor or peak or preferably the hat is made so that the insert 80 can be removed through a curved, elongate opening along the rear edge of the peak indicated by a dotted line at 82 in FIG. 3. It may be desirable to remove the insert 80 in order to wash or clean the hat. It will be understood that the insert 80 is located between outer cloth layers such as the outer layers 26 and 28 illustrated in FIG. 4. If the insert is made of a material which is completely opaque to all forms of light, then it will be appreciated that the peak or visor 20 may not require an inner cloth layer such as the layer 30 or 31 shown in FIG. 4. If desired an elastic strip (not shown) can be provided along the opening 82 in order to help hold the plastic insert in place. This elastic strip would be connected to the bottom cloth layer by suitable stitching.

It should be noted here that although hats and caps have been made from cloth materials in the past, most cloth materials will permit some damaging ultraviolet rays to pass through them, particularly thin, lightweight materials suitable for use in summer clothing. It should further be noted that the two outer layers 26 and 28 made of cotton and polyester are not themselves sufficient to stop 100% of all damaging ultraviolet rays from passing through. It is necessary to have at least one inner layer 30 or two inner layers made of a suitable material to prevent all damaging rays from the sun from passing through the hat or the flap. The use of an inner layer or two layers made of lightweight interfacing material provides a "breathing" fabric, meaning that it has a cooling effect on the wearer as air will pass through it more easily than other fabrics.

It will be clear from the above description that various modifications and changes can be made to the described hat and cap constructions without departing from the spirit and scope of this invention. Accordingly, all such modifications and changes as fall within the scope of the appended claims are intended to be part of this invention.

I therefore claim:

1. A cloth hat for warm weather use comprising:

a main section capable of covering the top of a user's head and having a top with a side wall extending down from the top to a peripheral edge;

a visor section connected to said peripheral edge at a front side of said main section, said visor section during use of the hat extending generally forwardly from the main section and having a width approximating the width of the hat; and a flap section connected to said peripheral edge at a rear side of said main section, said flap section during use of the hat extending generally downwardly from the sidewall of the main section a substantial distance which is sufficient to protect a user's neck from sun rays, wherein at least said main section and said flap section comprise first and second outer layers of tightly woven, thin, flexible cloth material and two thin inner layers of flexible cloth material sandwiched between said outer layers, said layers being secured together by stitching, both said visor section and said four layers of material in combination being sufficiently dense and opaque to prevent all ultraviolet sun rays from passing through the visor section and the layers to a user's head or neck.

2. A cloth hat according to claim 1 wherein said first and second outer layers are both made of woven cotton and polyester.

3. A cloth hat according to claim 2 wherein said visor section also comprises first and second outer layers of tightly woven, thin, flexible cloth material and two inner layers of flexible material, said layers in the visor section being secured together by stitching.

4. A cloth hat according to claim 3 wherein said flap section is generally rectangular in shape when laid out with its height being the shorter dimension and wherein the height of the flap section is at least five inches.

5. A cloth hat according to claim 3 wherein said two inner layers are a lightweight interfacing fabric comprising at least 50% polyester and having a maximum porosity of about 25%.

6. A cloth hat according to claim 1 wherein said visor section also comprises first and second outer layers of tightly woven, thin, flexible cloth material and at least one inner layer of flexible material, said layers in the visor section being secured together by stitching.

7. A cloth hat according to claim 1 wherein the top of said main section comprises a round or oval-shaped crown piece and the side wall thereof comprises a continuous band stitched to a peripheral edge of said crown piece.

8. A cloth hat according to claim 1 wherein said two inner layers comprise lightweight interfacing fabric.

9. A cloth hat according to claim 1 wherein said first and second outer layers each comprise 50% cotton and 50% polyester fibres.

10. A cloth hat according to claim 1 wherein said inner layers are made of a woven fabric comprising at least 50% polyester and having a maximum porosity of about 25% and a thread designation of at least about 138 per square inch.

11. A cloth hat according to claim 1 wherein said flap section is detachably connected to said peripheral edge by means of multiple hook and loop type connecting tape sections secured to a top edge of said flap section and to said main section.

12. A cloth hat according to claim 1 wherein said two thin inner layers both comprise lightweight interfacing fabric.

13. A cloth hat for warm weather use comprising:

a main section capable of covering the top of a user's head and having a top with a side wall extending down from the top to a peripheral edge;

a visor section connected to said peripheral edge at a front side of said main section, said visor section during use of the hat extending generally forwardly from the main section and having a width approximating the width of the hat; and a flap section connected to said peripheral edge at a rear side of said main section, said flap section during use of the hat extending generally downwardly from the sidewall of the main section a substantial distance which is sufficient to protect a user's neck from sun rays, wherein at least said main section and said flap section comprise first and second outer layers of tightly woven, thin, flexible cloth material and at least one thin inner layer of flexible cloth material sandwiched between said outer layers, said layers being secured together by stitching, both said visor section and said three layers of material in combination being sufficiently dense and opaque to prevent all ultraviolet sun rays from passing through the visor section and the layers to a user's head or neck and wherein said at least one inner layer comprises chopped strand mat made of polyester.

14. A cloth hat according to claim 13 wherein said flap section is generally rectangular in shape when laid out with its height being the shorter dimension and wherein said height of the flap section is at least five inches.

15. A cloth hat according to claim 13 wherein said flap section is generally rectangular when laid out and is connected to said peripheral edge at the rear and left and right sides of said main section and wherein said flap section provides good protection from sun rays at both the back and sides of a user's neck.

16. A cloth hat according to claim 13 wherein said flap section has two opposite ends generally located on opposite sides of the hat, said opposite ends each have a bottom corner section, and flap connecting devices are arranged on the bottom corner sections for the purpose of joining the opposite ends of said flap section together during use of the hat.

17. A cloth hat according to claim 13 wherein said visor section includes a relatively stiff, plastic insert extending substantially the width of the visor section and imparting a desired shape to the visor section, said plastic insert being removable through an elongate opening formed along one edge of the visor section.

18. A cloth hat according to claim 13 wherein said main section and said flap include two thin inner layers of flexible cloth material consisting of lightweight interfacing fabric.

* * * * *